United States Patent [19]

Bolli et al.

[11] Patent Number: 4,726,515

[45] Date of Patent: Feb. 23, 1988

[54] TRACK SYSTEM FOR TOY VEHICLES

[75] Inventors: Peter Bolli, Steinhausen; Heinz Looser; Werner Tanner, both of Baar, all of Switzerland

[73] Assignee: Interlego A.G., Baar, Switzerland

[21] Appl. No.: 18,705

[22] Filed: Feb. 25, 1987

[30] Foreign Application Priority Data

Feb. 27, 1986 [CH] Switzerland ..... 798/86

[51] Int. Cl.[4] ..... E01B 23/00

[52] U.S. Cl. ..... 238/10 E; 104/DIG. 1; 104/305; 238/10 R; 446/96; 446/444

[58] Field of Search ..... 238/1, 10 R, 10 A, 10 B, 238/10 C, 10 E, 10 F; 105/1.5; 104/DIG. 1, 305; 446/96, 444, 445, 446, 447

[56] References Cited

U.S. PATENT DOCUMENTS

| | | | |
|---|---|---|---|
| 931,418 | 8/1909 | Grant | 238/10 R |
| 3,594,940 | 7/1971 | Yonezawa | 446/96 |
| 3,690,031 | 9/1972 | Shinoda | 446/96 |
| 4,504,243 | 3/1985 | Barlow et al. | 446/447 |

FOREIGN PATENT DOCUMENTS

| | | | |
|---|---|---|---|
| 1703568 | 5/1973 | Fed. Rep. of Germany | 238/10 R |
| 2361191 | 6/1975 | Fed. Rep. of Germany | 238/10 A |
| 2622116 | 12/1977 | Fed. Rep. of Germany | 238/10 E |
| 3336927 | 4/1985 | Fed. Rep. of Germany | 238/10 A |
| 670659 | 6/1979 | U.S.S.R. | 238/10 R |

OTHER PUBLICATIONS

"Kaliko" Game, in Games Magazine, Nov. 1983, p. 47.

*Primary Examiner*—Galen Barefoot
*Assistant Examiner*—Thomas J. Brahan
*Attorney, Agent, or Firm*—Kane, Dalsimer, Sullivan, Kurucz, Levy, Eisele and Richard

[57] ABSTRACT

A track system for toy vehicles contains straight and curved track pieces at the end of which are reference points that coincide with symmetry points of a track grid having a track module, M, which is a multiple of a building module, m, of a base plate for mounting the track pieces. The length of the straight track pieces which are disposed either parallel to or diagonally with respect to the track grid are a multiple of or $\sqrt{2}$ times a multiple of the track module, M. The curved track pieces are composed of a longer arcuate segment and a shorter straight segment. The center of the arcuate segment is deplaced with respect to the center of an arc, whose center is a symmetry point of the track grid and whose two radii define an angular range of the curved track piece. The center of the arcuate segment is defined by the intersection of an angle bisector of the tangents (T) of the reference points on the ends of the curved track piece and one of the two radii.

15 Claims, 44 Drawing Figures

Fig. 33
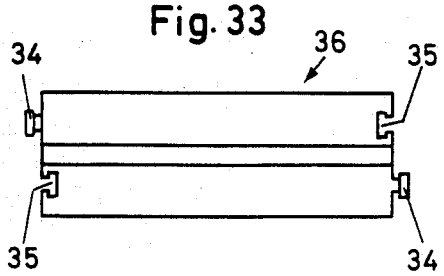
Fig. 34
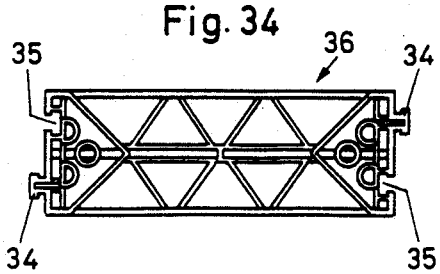
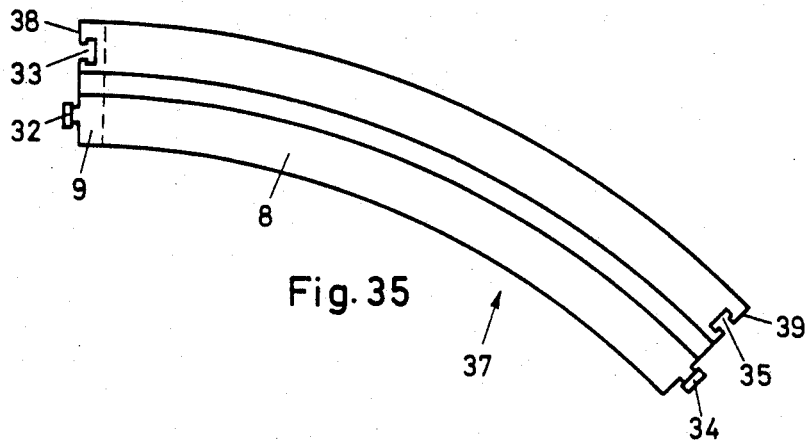
Fig. 35
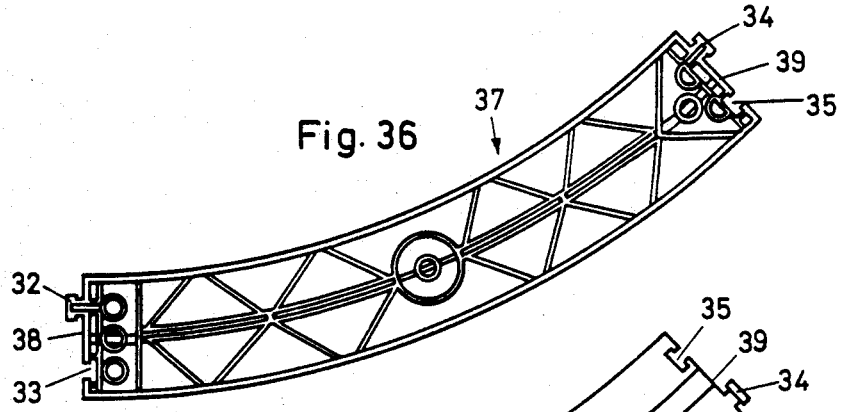
Fig. 36
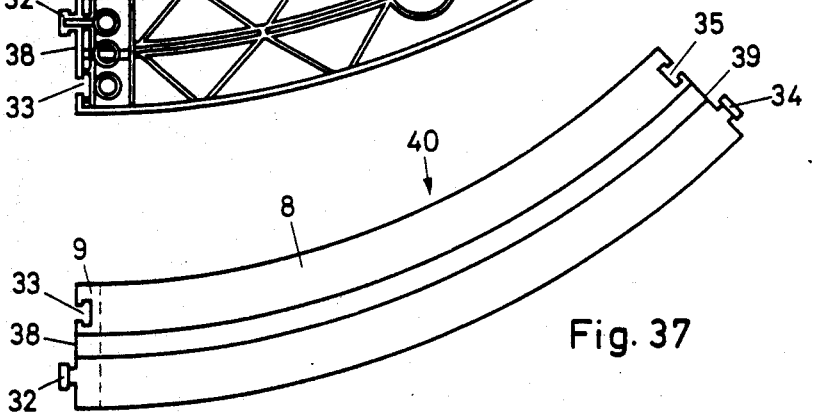
Fig. 37

Fig. 38
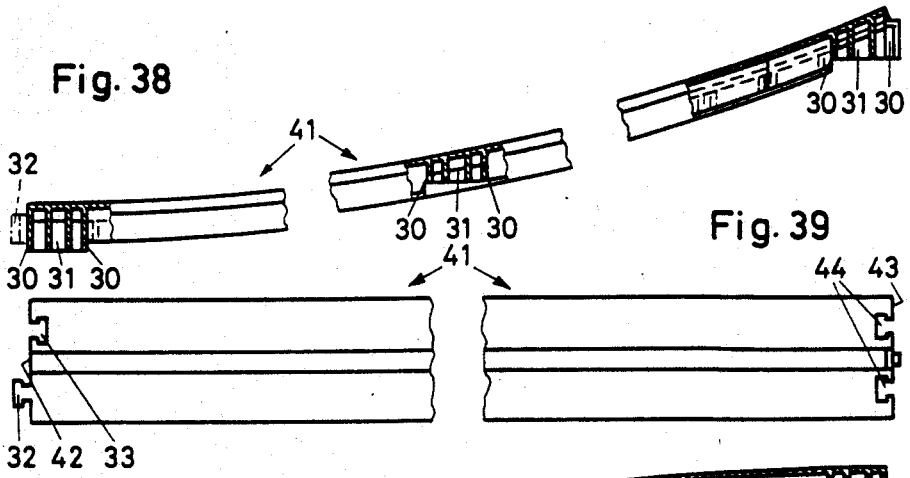
Fig. 39
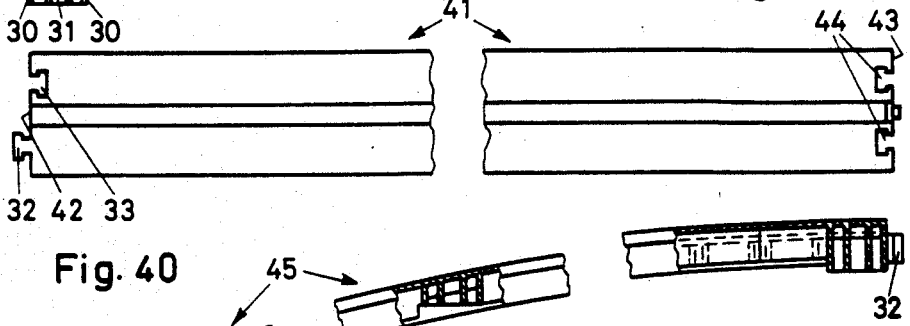
Fig. 40
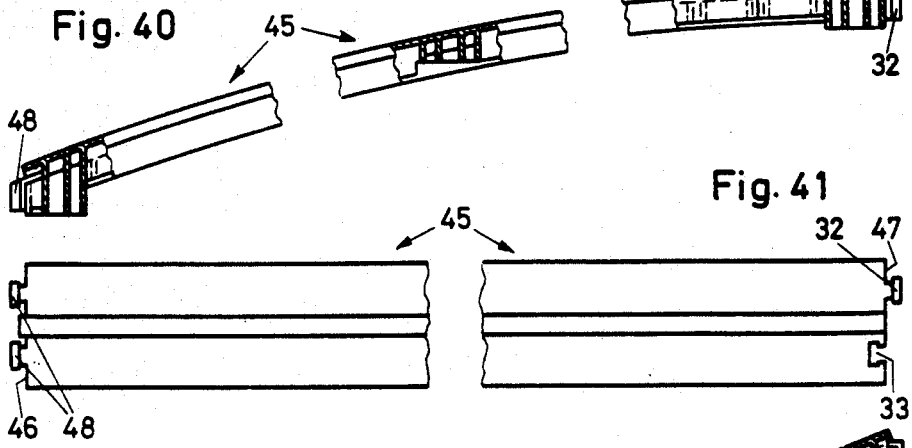
Fig. 41
Fig. 42
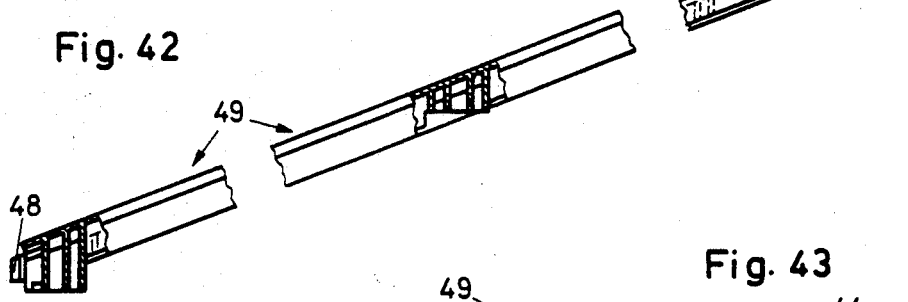
Fig. 43
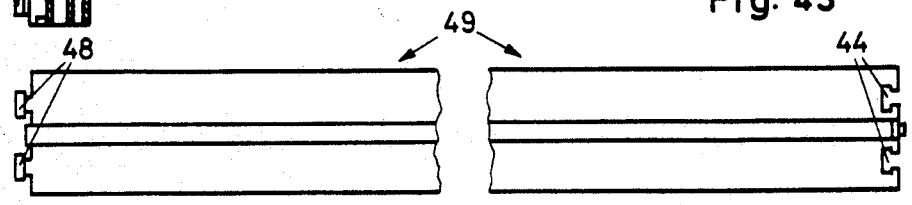

TRACK SYSTEM FOR TOY VEHICLES

BACKGROUND OF THE INVENTION

The present invention relates to track systems and in particular to a track system for toy vehicles.

In conventional track systems for toy trains the straight and curved rail or track pieces are installed on a surface which permits different lengths or graduated circular angles to readily be connected with little or no difficulty to form a closed configuration in a desired geometric pattern. To this end, straight and curved compensating or transition pieces are available to permit the desired track or rail pattern to be formed without any undo mechanical force being exerted on the connections of the track pieces or rail pieces.

Track systems are also available wherein the individual track or rail pieces are not only mechanically connected to each other but are also connected to a base or building plate which has a uniform grid of coupling elements for a toy-building system such as that for the familiar Lego® building blocks wherein the numerous building block elements are based on each element having primary and secondary coupling members, so that the building elements are mechanically connectable by being plugged into each other and can also be detached from each other. Such building elements are available in numerous embodiments shaped as blocks or plates and which are provided with coupling pins on a main face as well as with counter coupling members such as mating sockets on the opposite face. In this case the base plate is provided with primary coupling members such as coupling pins, arranged in the same manner and at the same spacing as the module for the building elements of the system.

Problems are encountered in such a building system if curved track pieces are to be used on one or a plurality of continuous base plates in the same manner as other building elements to form a track system connected with the base plate. The problem arises from it not being possible to connect straight and curved track pieces with each other and with the base plate which is provided with a single uniform square shaped grid of coupling members. Thus, in the prior art track system it is only possible to connect such track pieces by either tolerating mechanical forces exerted on the track pieces or by adding special compensation track pieces. The one, as well as the other of these measures impairs the toy and use value of such a track system considerably.

SUMMARY OF THE INVENTION

In view of the above, it is an object of the present invention to provide straight and curved track pieces for a track system of the aforementioned type which may be mounted on a base plate provided with a square grid of coupling elements and to mount the same without any difficulties and in such a manner that any forced connecting is completely eliminated. This is attained by having the two ends of each curved track piece correspond with grid points of the base grid.

Further, the curved track pieces in accordance with the present invention are categorized as either right or left curve pieces. In addition, the straight track pieces are categorized with respect to their length depending on whether these straight track pieces are to be used parallel to or diagonal to the grid of the base plate. Accordingly, it is advantageous to provide the ends of all track pieces with a mechanical or visual form of coding as to its intended use. Thus, the assembly of a plurality of track pieces into a track system becomes simple to use, even for children.

BRIEF DESCRIPTION OF THE DRAWINGS

In the accompanying drawings:

FIG. 33 is a top plan view of a straight track piece to be mounted diagonally to the grid of the base plate;

FIG. 34 is a bottom plan view similar to FIG. 33;

FIG. 35 is a top plan view of a curved track piece for a right having an angular range of 45°;

FIG. 36 is a bottom plan view similar to FIG. 35;

FIG. 37 is a top plan view of a curved track piece for a left curve having an angular range of 45°;

FIG. 38 is a side view, partially in section of a straight, lower ramp track piece;

FIG. 39 is a top plan view similar to FIG. 38;

FIG. 40 is a partially sectional view similar to FIG. 38 but of a straight upper ramp track piece;

FIG. 41 is a top plan view similar to FIG. 39 but of an upper ramp track piece;

FIG. 42 is a side, partially sectional view of a center ramp track piece;

FIG. 43 is a top plan view of the track piece of FIG. 42; and

DETAILED DESCRIPTION OF THE PREFERRED EMBODIMENTS

Figure 1:
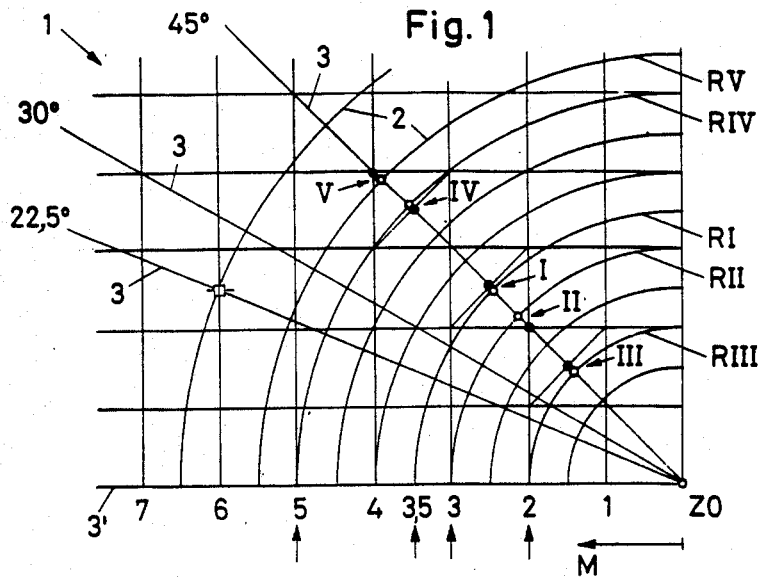
FIG. 1 is a diagram of concentric circular arcs with different radii and angular ranges laid out on a square grid, whereby the center of each circular arc is disposed in a corner of a grid section.

FIG. 1 illustrates a diagram from which it can be seen the deviations that are present between end points of different arcuate pieces with different radii and different angular ranges and the grid points of a square grid.

Thus, FIG. 1 depicts a square grid 1 with a grid module M, whereby the module M has a universal size, that is, the length of the sides of each square of grid 1 has a single unit value, M. Circular arcs 2 are plotted on the grid. The radius of each arc extends from a center, ZO, disposed in a corner of a square. The circular arcs 2 plotted in FIG. 1 have radius values of 1.5 M, 2 M, 2.5

M, . . . (0.5)(k)(M) wherein k is a whole number greater than 2. Furthermore, three different angular ranges for circular arcs of 22.5°, 30° and 45° are indicated in FIG. 1 by correspondingly inclined straight lines 3 which also extend from ZO.

The symmetry points of the square grid 1 are the corner points, center points or side bisecting points of the squares of the grid. In order to provide a track system wherein curved track pieces fall exactly into the given grid, these track pieces must be so designed that at least the ends defined along a center line extending through each track piece are geometrically in conformity with each other and with one symmetry point of one of the square of grid 1. However, such a conformity between arcuate track pieces and a square grid is impossible and FIG. 1 illustrates the deviations from the desired geometric conformity. Thus, in FIG. 1 the arcuate circular pieces centered at ZO are plotted along the lower horizontal grid line 3'. The radii are integers of M or (0.5)(integers of M). Lines 3 eminating from ZO at angles of 22.5°, 30° and 45° are also plotted. Thus, with one end of the arcuate pieces on line 3' it can be seen that the other end of the corresponding arcuate piece when intersected by one of the three lines 3 also intersects a symmetry point of the grid as follows:

For the line 3 at an angle of inclination of 22.5° an intersecting point with the circular arc 2 having a radius of 6.5 M lies almost at a symmetry point which is the bisect point of a side of a square of the grid.

For the line 3 at an angle of inclination of 30° there is no intersecting point disposed on a circular arc 2 that is in close proximity to a symmetry point of the grid.

For the line 3 at an angle of inclination of 45° there are the intersecting points with a plurality or circular arcs 2 that are also disposed in close proximity to symmetry points of the grid. These points are designated in FIG. 1 as I, II, III, IV and V.

Favorable intersecting points (i.e. in close proximity to a symmetry point of the grid) of the three lines 3 with circular arcs with larger radii are not illustrated in FIG. 1. However, it should be appreciated that in such cases the effective radii of the curved track pieces become relatively large and are therefore undesireable for a track system of the aforementioned type. As an example it should be stated that in an existing toy building system the grid module M has a value of 64 mm which is based on the system. Thus, arc 2 having a radius of 6.5 M (which intersects with line 3 having an angle of inclination of 22.5°) in the existing system would have a radius of 416 mm or a diameter of 83.2 cm. This would require an excessively large base plate for mounting the track pieces for the purpose of building a track system. Moreoever, it should be noted that the toy value of a track system of the aforementioned type is particularly high if a defined track pattern can be obtained with relatively few track pieces and few different types. For this reason, track pieces which, in accordance with FIG. 1, have an angle range of 22.5° and 30° are of less interest than those having a range of 45°. Accordingly, only curved track pieces having an angle range of 45° are discussed in more detail.

In FIG. 1 the actual intersecting points of the 45° line 3 and the circular arc; 2 are designated with open dots while the adjacent symmetry points of the grid 1 are designated by full dots. From this the following are obvious:

In case I the intersecting point of the line 3 and arc RI, which has a radius of 3.5 M, is slightly radially inward from the nearest symmetry point of the grid 1, namely the center point of a square.

In case II the intersecting point of the line 3 and arc RII, which has a radius of 3 M, is radially outward of the nearest symmetry point of grid 1, which is a corner point of a square.

In case III the intersecting point of line 3 and arc RIII, which has a radius of 2 M, is radially inward of the nearest symmetry point of grid 1, which, in turn is also the center point of a square.

In case IV the intersecting point of line 3 and arc RIV, which has a radius of 5 M, as in case II is radially outward of the nearest symmetry point of grid 1 which is the center of a square.

In case V the intersecting point of line 3 and arc RV, which has a radius of 5.5 M, as in cases I and III is radially inward of the nearest symmetry point of grid 1, which is a corner point of a square.

In cases I to V one end point of each track piece conforms exactly with a symmetry point of the grid 1 (i.e. along line 3') and the other end point of the track piece deviates only slightly from a symmetry point. "Slightly" in this context means that the radial deviation from the actual symmetry point is less than half of the length of the diagonal of a grid square. The subject invention is therefore based on the premise that it is possible to obtain the desired geometric conformity of at least the two end points of a curved track piece with the mentioned symmetry points of the grid 1 even, if the curved track piece is provided with a shape that deviates slightly from the actual conformity.

Figure 2:
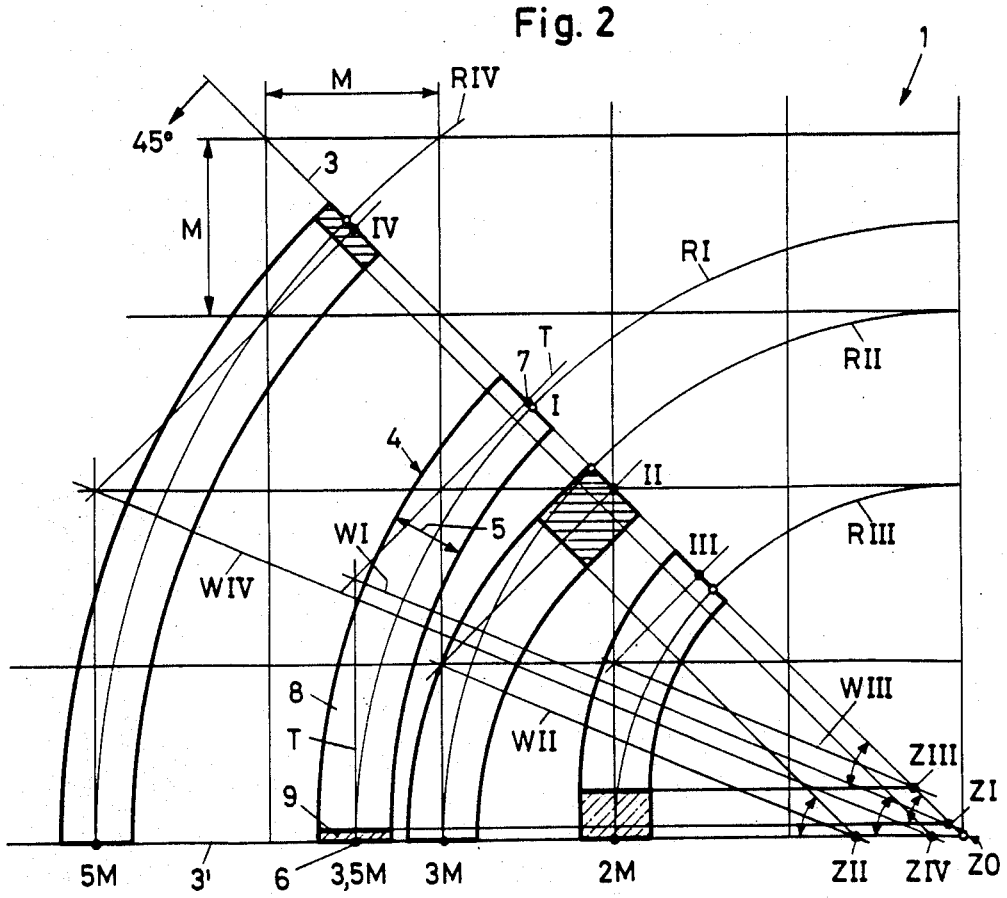
FIG. 2 is a diagram for explaining. the inventive shape of four curved track pieces encompassing an angle range of 45° of different graduated circles in accordance with FIG. 1.

Reference is now made to FIG. 2 which relates to cases I to IV of FIG. 1. Case V has been omitted for sake of clarity, and because it is based on a circular arc radius of 5.5 M, which is large for the desired application FIG. 2 again illustrates the square grid 1 with the grid module M in an enlarged scale which, in the following, is called the track module. FIG. 2 contains the 45° line 3 extending from center ZO and thus is diagonal to the squares it intersects. The intersecting points of line 3 with these circular arcs are again designated by open dots, while the actual symmetry points of grid 1, which should be in conformity with the reference points at the ends of the track pieces, are illustrated by means of full dots.

Track pieces 4 are schematically illustrated in FIG. 2, for cases I to IV of FIG. 1, in the form of curved strips with a maximum width 5. These designations are only entered for case I for clarity sake. The two ends of a center line, not illustrated, of track pieces 4 (also see FIG. 3) are defined as reference points of these track pieces which accordingly coincide with the mentioned symmetry points of grid 1 and base the reference numerals 6 or 7. As illustrated, each track piece 4 consists of a circular segment 8 and a straight segment 9, which is illustrated in hatched lines.

In accordance with the invention the circular segment 8 of each track piece 4 is defined by the following fixing of its center. A tangent requirement must be met in the end points 6 and 7 of each track piece which is in conformity with the symmetry points of grid 1, in that in the subject case wherein the track pieces extend over an angle range of 45° the tangent must be disposed on the track piece or its center area in an end point of the track piece parallel or vertically with respect to the grid 1 and in the other end point of the track piece in the diagonal direction of the grid 1. As a result track pieces may be fittingly attached. The straight segments of the track pieces do not influence the tangent direction of the ends of the track pieces. The given angle bisections WI to WIV of these tangents are drawn for all cases I to IV in FIG. 2.

The center of the circular segment 8 of each track piece 4 results from the intersecting point of the given angle bisection with one of the radii which limit the angle area of the track piece, that is, as far as FIG. 2 is concerned, from the intersecting point of the given angle bisection WI to WIV with the line 3 or the horizontal radial line 3'. This results from the fact that each track piece consists of a curved and a straight segment so that one end of the track piece is the end of its curved segment which consequently coincides with one of the mentioned radii.

The center of circular segments 8 of curves RI to RIV are designated ZI to ZIV, respectively. These centers are located by the intersection of the bisector (WI to WIV) of the angle between the tangents of the end points and either line 3 or 3'.

By fixing the centers ZI to ZIV of the circular segments 8 of the track pieces 4 the straight segments 9 of the track pieces 4 are also fixed, since each circular segment 8 extends over an angle range of 45° around its center ZI to ZIV. Thus, each circular segment 8 is supplemented at the given end by a straight segment at the opposing end which contains the radius of the corresponding center. Thereby, the straight segment 9 extends to the other radius and is provided with a length which is equal to the vertical distance of the corresponding center from this other radius.

The resulting straight segments 9 of the track pieces 4 for the cases I to IV are illustrated in shaded lines in FIG. 2. From this it can be seen in particular that when the intersecting point of the corresponding original circular arc RI . . . RIV with the center ZO is disposed radially inwardly from the next symmetry point of the screen 1 with the 45° line 3, the straight segment 9 is disposed on the side of the horizontal radial line 3' and vice versa. Furthermore it can be seen that the length of the straight segment 9 is larger by the amount of the deviation from the geometric coincidence. This circumstance can, as will be explained in the following, be a criteria for the selection of a defined shape of the track piece for a track system.

In conjunction with FIG. 3 it is explained in the following how the position of the given center of the circular segment 8 of the track piece is fixed in grid 1 or how the radius of this segment 8 is fixed in practice. FIG. 3 again illustrates the square grid 1 with the track module M corresponding FIG. 2. The curved track piece 4 which has the track width 5 corresponds to case I in FIG. 2 and is now explained by way of example. ZO again designates the center of the original circular arc RI of FIG. 2 (not illustrated in FIG. 3). With respect to a center line 10 the track piece 4 has a first end point 6 which is disposed at a distance of 3.5 M from the center ZO on radial line 3', that is, in a symmetry point of grid 1. The other end point 7 of the track piece 4 is disposed in the center of a square of grid 1 on the diagonal line 3. The two tangents, T, on center line 10 are illustrated passing through the end points 6 and 7. Their angle bisector WI intersects, as already explained in conjunction with FIG. 2, the line 3 at point ZI which forms the center of the circular arc 8 of the track piece 4. Furthermore, in FIG. 3 the measured distances of the end point 7 from the center ZI are designated "x". The radius of the center line 10 of the circular segment 8 is designated "y", while "z" and "z'" designate the distances of the center ZI of segment 8 from the original circular arc center ZO. In the subject example z=z' for reasons of symmetry.

Figure 3:
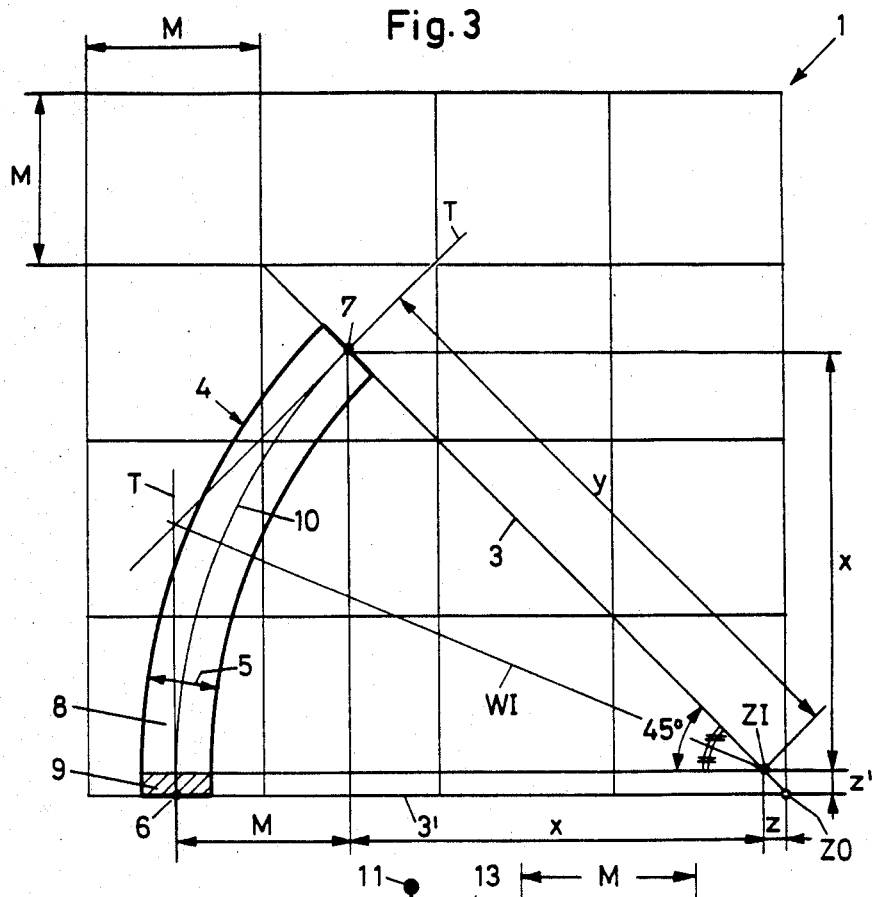
FIG. 3 is a further diagram of a curved track piece of FIG. 2 for explaining the determination of the radius of the curved segment and the length of the straight segment of the track piece.

It can be seen from FIG. 3 that y=M+x, on the one hand, and $y=x\sqrt{2}$, on the other hand and that Z=3.5 M−y. From this one obtains the values for y and z, namely:

$$y = \frac{\sqrt{2}}{\sqrt{2}-1} \cdot M \text{ and } z = \left(3.5 - \frac{\sqrt{2}}{\sqrt{2}-1}\right) \cdot M$$

whereby $z' = z$

The magnitude of the track module M may be defined by the building element system. By way of example, such a track module may be M=64 mm, as has already been mentioned. Such a track module is already defined on a base plate in a building element system wherein the building elements may be used to form roads, groups of houses and the like. Consequently, for the curved track piece 4, depicted in FIG. 3, the corrected radius y of the circular segment 8 with respect to its center line 10 has a length of 218.5 mm and the displacements z and z' of the center ZI of the circular segment 8 which corresponds to the length of the straight segment 9 is 5.5 mm.

Similarly the values y and z or z' may be defined for other cases, in particular the cases II to VI of FIG. 2. For the cases II and IV of FIG. 2 and similar cases it is preestablished that z'=0 since the given center ZII or ZIV is disposed along line 3'.

Which of the embodiments of the inventive track system may be advantageously selected for a specific building element system would depend on the following different factors:

(1) One has to take into consideration the total width of the intended track. At any rate it must be smaller than the track module M.

(2) It is then important to select the uncorrected radius of the circular arc. The larger this radius is selected or permitted, the larger is the space requirement for the base plate and the amount of material needed for the individual track pieces. For each of the cases discussed in conjunction with FIG. 1 and FIG. 2 as well as for any other feasable case a number can be defined which states the amount of the required track modules M for a given track radius including the width measurement of the track pieces.

(3) The possible track distance between parallel tracks in a defined shape of a curved track piece is also influential. With respect to FIG. 2, this minimum parallel distance is obtained in that corresponding left curved track pieces are attached to right curved track pieces, illustrated in FIG. 2, so that a parallelity is obtained by the connected straight track pieces at both ends.

(4) Finally, it may be of importance whether a system of a plurality of curved and straight track pieces results in a proper blending. This is not the case if the length of the straight segment 9 of the curved track pieces 4 (FIG. 2) is relatively large and a straight segment 9 is present at the 45° inclined end of a track piece, see cases II and III or II and IV in FIG. 2.

For the cases I to IV illustrated in FIG. 1 or for the cases I to IV illustrated in FIG. 2 data is listed in the following table in accordance with the criteria of the aforementioned points 2, 3, and 4, namely:

Column 1: The value of the uncorrected radius of the corresponding circular arc RI to RV (FIG. 1);

Column 2: The amount of required track modules M taking into consideration the width of the track;

Column 3: The track distance of parallel tracks;

Column 4: The corrected radius of the circular segment 8 of a given track piece 4;

Column 5: The length of the straight segment 9 of the corresponding track piece 4;

Column 6: The percent relationship of the length of the straight segment (fifth column) and the corrected radius of the circular segment (fourth column).

This dimensional relationship number (Column 6) represents useful coefficient for the corresponding track piece in that it indicates which percentage part of the straight segment has with respect to the circular segment. This relationship number is therefore a measure of the relative deviation of the intersecting points with the 45° line and the associated symmetry point of the track grid for the reference point at the one end of the track piece, see FIG. 1. This relationship number would be equal to zero if there was no deviation. In practice it is advantageous to select a track piece with a minimum relationship number since the relative length of the compensating straight segment is small and the corrected radius of the circular shaped segment deviates only to a small degree from the uncorrected circular arc radius.

TABLE

| Case | 1 Uncorrected Radius of the Circular Arc | 2 Number of Required Track Modules M | 3 Track Distance of Parallel Tracks | 4 Corrected Radius of the Arc Segment | 5 Length of the Straight Segment | 6 Relationship Number |
|---|---|---|---|---|---|---|
| I | 3.5 M | 4 | 2 M | 3.4142 M | 0.0858 M | 2.5 |
| II | 3 M | 3.5 | 2 M | 2.4142 M | 0.4142 M | 17.2 |
| III | 2 M | 2.5 | 1 M | 1.7071 M | 0.2929 M | 17.2 |
| IV | 5 M | 5.5 | 3 M | 4.8285 M | 0.1213 M | 2.5 |
| V | 5.5 M | 6 | 3 M | 5.1213 M | 0.3787 M | 7.4 |

In short the data listed in the table can be stated as follows:

The two criteria "number of the required track modules M" (space required) and "track distance in parallel tracks" appear to be advantageous for case III. However, a considerable disadvantage is that the straight segment of each track piece has a relatively considerable length which is reflected by the high value of the relationship number. Thus, it is not possible to build a closed track with eight track pieces of case III, and have a somewhat circular shape.

The next larger case II does not offer any advantage over case III, but only disadvantages. Firstly, the number of the required track modules M is larger by 1 M. Secondly, the track distance in parallel tracks is double the size of case III. Thirdly, the relationship number is equally high as for case III.

Favorable data is provided in a track piece in accordance with case I. The space requirement with four track modules is only a little larger than in case II. In addition, the track distance for parallel tracks is 2 M. However, as can be seen from the data for the corrected radius of the arc segment and for the length of the straight segment and in particular from the value of the relationship number, a track piece which extends over an eight of a curve in accordance with case I deviates only slightly from the circular shape; in this respect it is almost ideal.

The track piece in accordance with case IV is provided with an equally low relationship number, that is, a good approximation to the circular shape. However, in case IV the space requirement (number of the required track module M) and the distance for parallel tracks are so large that the use of such track pieces would only be of interest where, in the corresponding toy-building system the given track module M, in absolute length units, is relatively small.

Finally, case V, which is not illustrated in FIG. 2, is practically without any interest as compared to case IV, because of its somewhat higher number of required track modules M and its relationship number which is about three times larger than case IV.

In summary it can be stated that the curved track pieces in accordance with case I offer the most advantages. The following description of embodiments of curved track pieces is therefore limited to track pieces of the structure in accordance with case I in FIG. 2, without, however, limiting the subject invention to this case.

Figure 4:
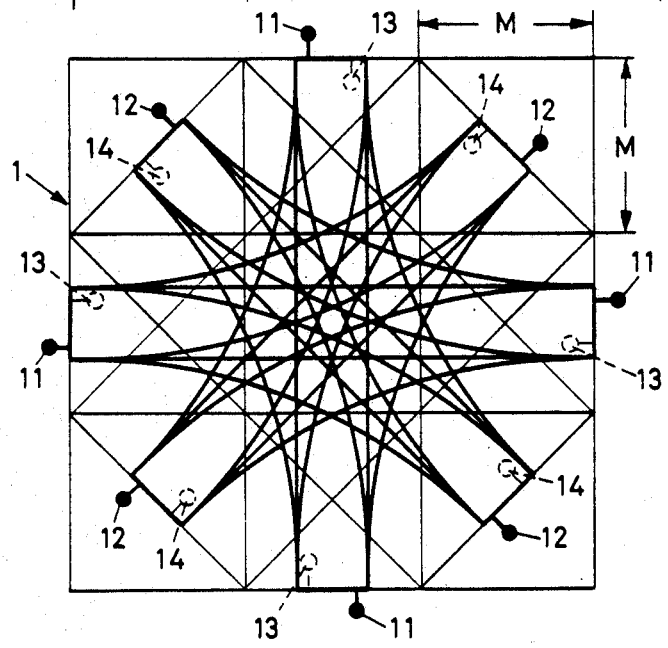
FIG. 4 is a diagram of curved and straight track pieces in accordance with one exemplified embodiment of the invention.

In FIG. 4, the track grid 1 with track module M is shown with all possible curved track pieces as well as all straight track pieces on the grid in accordance with case I in positions turned by about 45°. The illustrated curved track pieces do not need a further explanation in view of the aforementioned description. The illustrated track pieces have a length, which, in accordance with the invention, is in a fixed relationship with respect to the track module M of the track grid 1. In the illustrated embodiment of FIG. 4 all straight track pieces, which are disposed parallel to the track grid 1, have a length of 3 M and the straight track pieces which are disposed diagonally with respect to the track grid 1 have a length of $2\sqrt{2}$ M. Instead of the factors k=3 or k=2 other factors k are applicable for the lengths of the straight track pieces, as long as the condition is met that the reference points on the ends of the track pieces coincide with the symmetry points of the track grid 1. Accordingly, the factor k can have the values 0.5 - 1 - 1.5 - 2 - 2.5 as long as the previous defined reference point for the curved track pieces in the positions of FIG. 4 is always disposed in the mid point of a side, a center point of a grid square, or a corner point of a grid square.

Coding elements 11, 13, or 12, 14 are schematically indicated in FIG. 4 on the ends of all straight and curved track pieces. These coding elements assure that a defined track piece can only be connected with another track piece if the shape of the further track piece is such that the coincidence of the defined reference point of the first mentioned track piece coincides with a symmetry point of the track grid 1 by the further extended track piece. It can be seen that the curved track pieces have to be separated into two groups of different shape, namely into right and left curved track pieces. This is also true for the straight track pieces which are separated based on whether they are defined for mounting parallel to the grid or for the mounting diagonally with respect to the grid. Thus, a track system in accordance with the invention, as long as it is built in a single plane, will basically encompass four different groups for track pieces, whereby half of them are the curved (left and right) and half are straight track pieces (parallel or diagonal).

As schematically indicated in FIG. 4 the coding elements consist of protrusions 11, 12 which extend from each end of the track pieces and corresponding recesses 13, 14. Two given track pieces of FIG. 4 can therefore only be connected with each other when during the desired assembly the protruding coding element 11, 12 of the one track piece is opposite the recessed coding element 13, 14 of the other track piece, so as to bring these corresponding coding elements into engagement with each other. If this is not possible, because one protruding coding element 11, 12 of the one track piece is opposite another protruding coding element 11, 12 of the other track piece, the user must then select and attach the other of the two different and differently coded track pieces of the same group of either curved or straight track pieces. Thus the constructing of an inventive track system is possible without any training, know-how or experience.

Moreover, for assuring the mentioned correct connection of two track pieces to be connected a very simple base rule is established for the design of the coding. The coding on the ends of the track pieces must only be different, depending whether the corresponding end is disposed parallel of diagonal to the track grid 1.

This basic rule can be clearly seen in FIG. 4. At the ends which are disposed parallel to the track screen 1 the protruding coding element 11 is provided at the one side of the end face of the track piece, and correspondingly the recessed coding element 13 is mounted on the other end of this end face. At the ends which are disposed diagonally with respect to the track screen 1, the arrangement of the coding elements 12, 14 on the end faces of the track pieces is exactly opposite.

Practical embodiments of the schematically illustrated coding elements 11, 12, 13, 14 of FIG. 4 are explained in the following in conjunction with FIGS. 27 to 29. Further embodiments of the same coding for track pieces, which are defined for making inclines or ramps will be explained later in conjunction with FIGS. 38 to 43.

A plurality of track examples are depicted in FIGS. 5 to 26 which are similar to FIG. 4. These figures depict individual track pieces, as well as track pieces which are assembled to form intersections and switch points.

Figure 5:
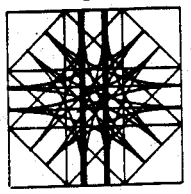
FIG. 5 to FIG. 26 are diagrams of individual track pieces of FIG. 4.
Figure 6:
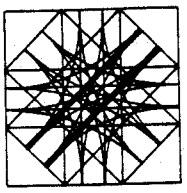

FIG. 5 illustrates a track piece which is mounted parallel to the track grid. FIG. 6 illustrates a straight track piece which is mounted diagonally with respect to the track grid.

Figure 7:
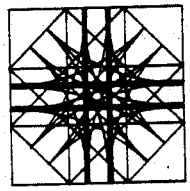
Figure 8:
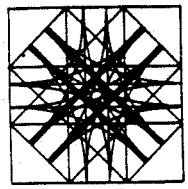

FIGS. 7 and 8 each illustrate 90° intersections made from two straight track pieces. In FIG. 7 the track pieces are disposed parallel while in FIG. 8 the pieces are disposed diagonally with respect to the track grid.

Figure 9:
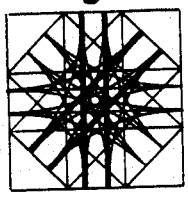
Figure 10:
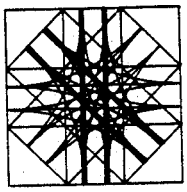

FIGS. 9 and 10 each illustrate 45° intersections in right or left position with respect to the straight track grid running parallel to the track grid.

Figure 11:
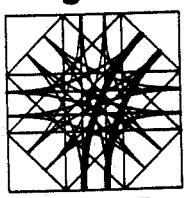
Figure 12:
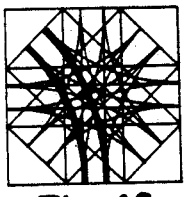

FIG. 11 illustrates a right curved track piece and FIG. 12 illustrates a track piece which is curved to the left.

Figure 13:
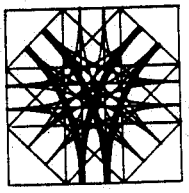
Figure 14:
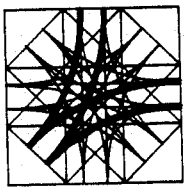
Figure 15:
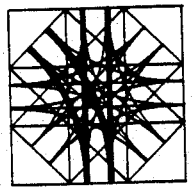

FIG. 13 illustrates a combination of the two curved track pieces from FIGS. 11 and 12 in the form of a curved switching point, whose symmetry axis is disposed parallel to the track grid. FIG. 14 illustrates a similar curved switching point, whose symmetry axis extends diagonally to the grid.

Figure 16:
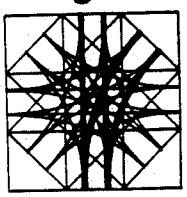
Figure 17:
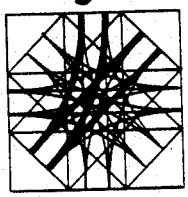
Figure 18:
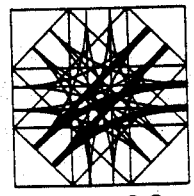

FIGS. 15 to 18 illustrate combinations of straight and curved pieces of track in the form of left switching points (FIGS. 15, 17) and right switching points (FIGS. 16, 18). The straight track piece is mounted parallel to the track screen in the embodiments of FIGS. 15 and 16, while in the embodiments of FIGS. 17 and 18 it extends diagonally with respect to the track grid.

Combinations of a straight track piece and two curved track pieces are illustrated in FIGS. 19 to 24 and require no further discussion.

Figure 19:
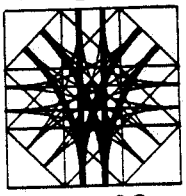
Figure 20:
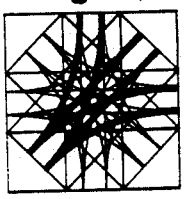
Figure 21:
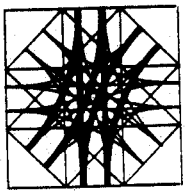

FIGS. 19 and 20 each illustrate double switching points wherein the straight track piece is disposed parallel to the track grid or diagonally with respect to the track grid. The branches consist of one each right or left curved track piece.

Figure 22:
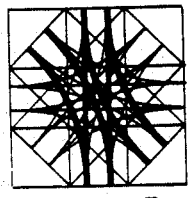
Figure 23:
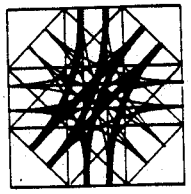
Figure 24:
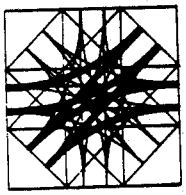

FIGS. 21 to 24 illustrate embodiments of assembled switching point arrangements which permit, in addition to a straight passage over a straight piece of track in both driving directions, a turning off to the right (FIGS. 21, 24) or to the left (FIGS. 22, 23). The straight piece of track is disposed parallel to the track grid in FIGS. 21 and 22, while it is disposed diagonally with respect thereto in FIGS. 23 and 24.

Figure 25:
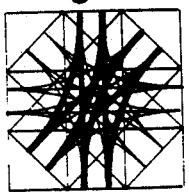
Figure 26:
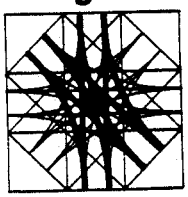

Finally two 4520 intersection switching points to the right or to the left are illustrated in FIGS. 25 and 26.

In the track examples of FIGS. 11 to 26 the curved track pieces are shaped corresponding to case I in FIG. 2 and corresponding to FIG. 3 with opposite curve directions. Furthermore, in all track examples of FIGS. 5 to 26 both ends of the given straight or curved track pieces are provided with coding means (not illustrated) mounted in an arrangement as illustrated in FIG. 4.

Examples of the indexing or coding means which are provided on the ends of the track pieces will now be described in conjunction with FIGS. 27, 28 and 29. In these figures the end areas of two track pieces 15 and 16 are illustrated which have to be connected with each other on their front side and end faces. As can be seen from FIGS. 27 and 28, the front side end faces of the two track pieces 15 and 16 are provided with one each protrusion 17 or 18 and a recess 19 or 20. The protrusions 17, 18 and the recesses 19, 20 are shaped in such a manner that during the sliding the two track pieces 15, 16 together one each protrusion 17, 18 engages into the opposite recesses 20, 19. The exemplified embodiment of FIG. 28 differs from the one of FIG. 27 in that the protrusions and recesses are disposed on the side edges of the end faces, while in FIG. 27, they are disposed inward of the end faces.

Figure 27:
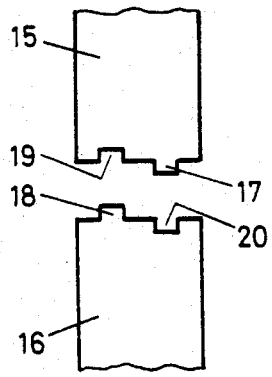
FIG 27 to FIG. 29 are schematic illustrations of coding elements on track pieces.
Figure 28:
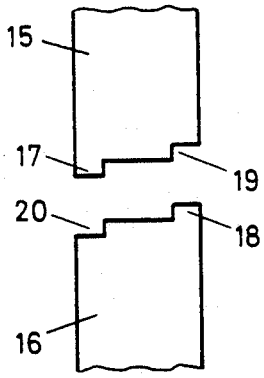
Figure 29:
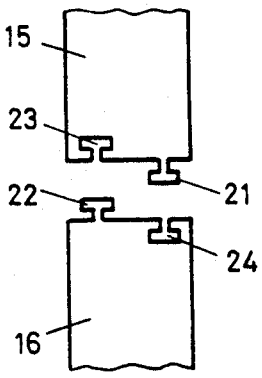

The protrusions and recesses illustrated in FIGS. 27 and 28 have no retaining effect, that is, the two track pieces 15 and 16 cannot be mechanically retained in a fixed position by means of the protrusions and recesses, but can be detachably coupled. The mechanical fixing of the track pieces is effected in that they are plugged onto a base plate which is provided with coupling members, for example, coupling pins and/or they can be detachably mounted by small faced coupling elements, for example, with coupling pins which are provided on plates or the like.

In the exemplified embodiment of FIG. 29 the protrusions 21, 22 and the corresponding recesses 23, 24 are dovetailed, so that the two track pieces 15, 16 may be coupled from above or below to hold in the longitudinal direction by introducing the protrusions 21, 22 into the corresponding recesses 24, 23.

A coding of different track pieces which are not designed to be connected with each other by means of the coding elements which consist of protrusions and recesses is performed in that the protrusions and correspondingly the recesses are provided at different places along the end faces of the track pieces. For example, in the plan views of the track pieces 15 of FIGS. 27 to 29 the protrusions 17, 21 which are mounted on the one edge are mounted on the other edge, so that a second coding is obtained which does not coincide with the first coding of the track pieces 16 of FIGS. 27 to 29. Such track pieces can not be connected with each other. These two coding members are schematically illustrated in FIG. 4.

A third type of coding, whose use will be explained in the following, is obtained by providing in the end face of the one track piece two protrusions and the end face of the other track piece which is to be connected therewith two corresponding recesses. Track pieces provided with such coding elements can only be combined with track pieces of the same type.

It is obvious that numerous other embodiments of coding elements on the ends of the track faces are feasible, for example, simple visual markings, magnetic numbers, etc. The coding elements described in conjunction with FIGS. 27 to 29 or similar ones have the advantage that they forcibly prevent any nonwanted connection of track pieces, on the one hand, and that they do not require any additional elements, on the other hand, but can be directly molded to the ends of the track pieces.

The subject coding on the ends of straight and curved track pieces as well as of track pieces for forming an incline or ramp will be explained in the following in conjunction with further examples of track pieces which are illustrated in FIGS. 30 to 43.

Figure 30:
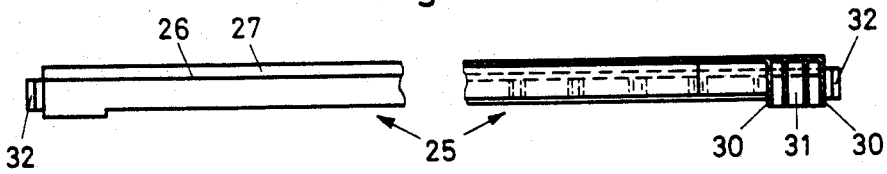
FIG. 30 is a side view, partially in section, of a track piece in accordance with the present invention.
Figure 31:
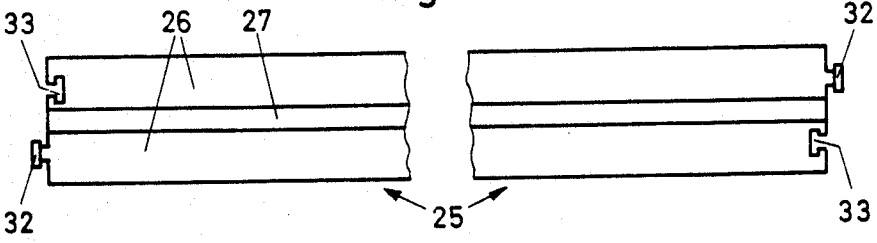
FIG. 31 is a top plan view of the track piece of FIG. 30.
Figure 32:
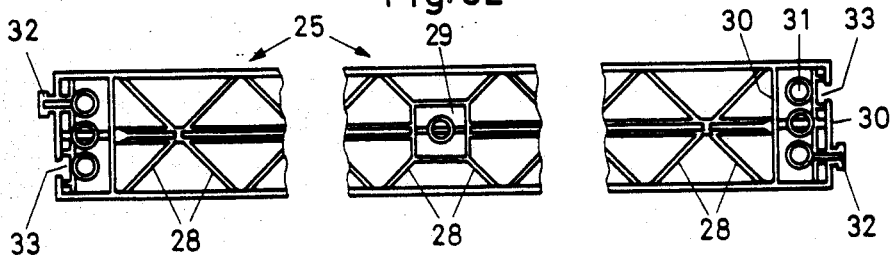
FIG. 32 is a bottom plan view of the track piece of FIG. 30.

A straight track piece 25 is illustrated in FIGS. 30 to 32. The track piece 25 is designed to be mounted parallel to the grid of a base plate. For the sake of simplicity here and in the following figures a track piece is illustrated in form of a flat rod. The track piece 25 has a smooth surface 26 on its upper side for the wheels of a vehicle as well as a center rib 27 as a guide element for the vehicle. The lower side of the track piece 25 is substantially hollow and is provided with reinforcement ribs 28. On both ends the track piece 25 is provided, on its bottom surface, with counter coupling numbers which in a known manner consist of transverse walls 30 and hollow pins 31 positioned to receive cylindrical coupling pins, which are mounted on a base plate in a grid having a building module M. The track pieces can thus be plugged on the base plate in the intermediary spaces between the transverse walls 30 and the hollow pin 31 in the same manner as conventional building blocks would be plugged onto the base. A counter coupling member 29 is also provided in the center of track piece 25 for the same function. The two end faces of the track piece 25 are provided with one each dovetail like protrusion 32 and symmetrically thereto with a corresponding recess 33, as illustrated in FIG. 29. It can be seen in the plan view of both end faces that the protrusion 32 is provided at the right from the center and that the recess 33 is provided left from the center. The track piece 25 is preferably made from plastic in one piece.

A straight track piece 36 is illustrated in a top and bottom plan view, in FIGS. 33 and 34. Track piece 36 is designed to be mounted diagonally to the grid of its base plate. The track piece 36 is shaped in the same manner as the track piece 25 of FIGS. 30 to 32. However, it has two substantial differences in that its length contains the factor $\sqrt{2}$ with respect to the length of the track piece 25 to enable it to assume a diagonal position, and in that its protrusions and recesses are arranged differently on the end faces. Thus, in both end faces a protrusion 34 is provided at the left from the center in the track piece 36 or a recess 35 at the right of the center. This arrangement prevents the diagonal track piece 36 from being connected with a parallel track piece 25.

A right curved track piece 37 is illustrated in FIGS. 35 and 36 which has the same structure and which is combined in accordance with the invention from a circular segment 8 and a straight segment 9 (see FIG. 2, case I or FIG. 3). The protrusions and recesses which are provided as coding elements on the end faces of the track piece 37 is as follows:

At the end face 38, which is designed to be disposed parallel to the grid of the base plate the position of the protrusion 32 and the recess 33 coincides with the corresponding coding elements on the end faces of the straight parallel track piece 25 (FIGS. 30 to 32), that is, the protrusion 32 in the plan view of the end face 38 is located at the right from the center and the recess 33 is left from the center.

On the other end face 39 which is designed to be disposed diagonally to the grid of the base plate the position of the protrusion 34 and the recess 35 coincides with the corresponding positions of these coding elements on the end faces of the straight, diagonal track piece 36 (FIGS. 33 and 34), that is, the protrusion 34 in the top plan view of the end face 39 is located at the left of center and the recess 35 is right of center.

Thus, the curved track piece 37 can only be connected on its one end, having the straight segment 9, with a parallel straight track piece 25 and at its other end only with a diagonal straight track piece 36. The same is true for a left curved track piece 40 as illustrated in FIG. 37. A quarter circle (90°) turn can be formed by connecting a curved track piece 37 (FIG. 35) with a curved track piece 40 (FIG. 37). The second ends (with the straight segment 9) will be parallel to the grid of the base face and hence perpendicular to each other. As can be seen the coding with the protrusions and recesses does not offer any other connecting possibility for forming a quarter circle. However, if an S-curve should be formed, two track pieces 37 or 40 (FIGS. 35, 37) must be attached with each other for the same reason, since this connecting possibility is the only one which permits the described coding.

If the track system is to have straight ramps with inclines or slopes, particular track pieces are required, namely:

a track piece for the transition from the horizontal to the incline of the ramp;

a track piece for the transition from the incline of the ramp to the horizontal at a higher level and, if so desired, one or a plurality of straight track pieces for extending the length of the ramp.

Suitable track pieces for the above are illustrated in FIGS. 38 to 43. Thus, the track piece 41 illustrated in FIGS. 38 and 39 is designed to form the transition from a horizontally mounted track piece to the ascending inclined position of a track ramp. Therefore, the track piece 41 is provided at its one end 42 with a horizontal track which has an upwardly directed curvature which extends to its other end 43. However, in its longitudinal direction the track piece 41 is straight as shown in FIG. 39

In the same manner as the previously described track pieces, the track piece 41 is provided with a hollow underside which is provided at the ends 42 and 43 as well as in the center with transverse walls 30 and hollow pins 31 to define counter coupling sockets to enable the track piece to be plugged at the end 42 onto a base plate which is provided with corresponding coupling pins. The length of the track pieces 41, in accordance with the present invention, is such that they relate to the modules M of the track grid, that is, the horizontally projected length of the track piece 41 (FIG. 39) is a multiple of the track module M.

The ends 42 and 43 of the track piece 41 are also provided with coding means of the type described in conjunction with FIGS. 30 to 37. The one end 42 for horizontal and parallel connection with respect to the track grid to a further straight or curved track piece has therefore the same and equally arranged coding means, namely a protrusion 32 and a recess 33 as the straight track piece 25 of FIG. 31 or the curved track pieces 37 and 40 of the FIGS. 35 or 37. A special track piece must be connected to the other end 43 of the track piece 41 which either continues the ramp in a straight line and plane or forms a transition to the horizontal on a higher level. Consequently, the end 43 is provided with a third type of coding on its end face consisting of two recesses 44, so that this end is not connectable to any of the hitherto described track pieces.

A track piece 45 is illustrated in FIGS. 40 and 41 which is similar to the track piece 41 and is designed to transit the inclination of the ramp at the end 43 of the track piece 41 again into the horizontal so that accordingly an equal but opposite curvature is provided. Again, coding means are formed on the ends 46 and 47 of the track piece 45. The end 46 is provided with two protrusions 48 and its end face for an engagement into the two recesses 44 of the track piece 41, while the other horizontal end 47 again has a recess 33 for connecting a track piece 25, 37 or 40 in accordance with FIGS. 31, 35 or 37.

A further ramp track piece 49 is illustrated in FIGS. 42 and 43 which is defined to extend the ramp with a constant incline. This straight, planar track piece is therefore provided at its one end with two projections 48 and at its other end with two recesses 44 so as to enable the connection to the track piece 41 (FIGS. 38, 39) or to the track piece 45 (FIGS. 40, 41) or to a similar ramp track piece 49.

Figure 44:
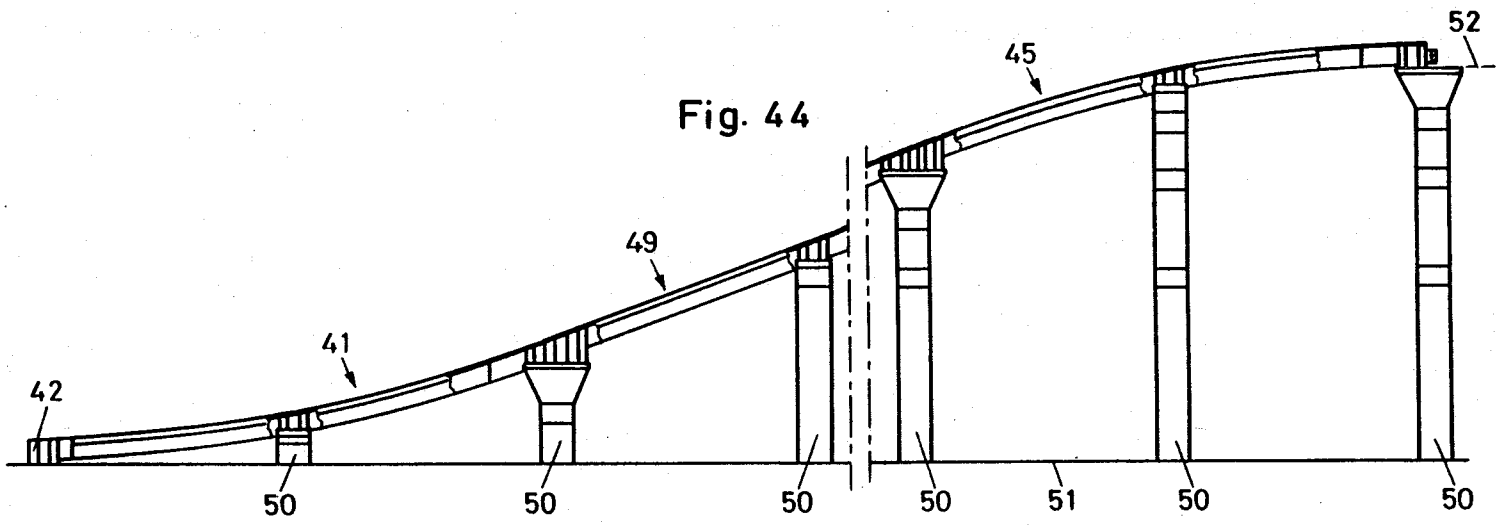
FIG. 44 is a side, partially sectional view of a track segment with straight ramp track pieces in accordance with FIGS. 38–43.

Finally, a complete ramp is illustrated in FIG. 44 which is composed of a track piece 41 (FIGS. 38, 39), a track piece 49 (FIGS. 42, 43) and a track piece 45 (FIGS. 40, 41). The horizontal end 42 of the track piece 41 as well as posts 50 for supporting the track pieces 41, 49, 45 are plugged into a base plate 51. It is obvious that on the higher horizontal level 52 the track may be continued by means of track pieces 25, 37 and 40 of the aforementioned type (FIGS. 30 to 32 and 35 to 37) in a given manner and by using corresponding posts, as well as by means of a further descending ramp in accordance with FIG. 44 by adding a track piece 45 (FIGS. 40, 41) or by means of a further ascending ramp by adding a track piece 41 (FIGS. 38, 39). Naturally curved ramp track pieces are possible, preferably with an arcuate range of 90°.

Track pieces were previously described which have the shape of a flat rod which is straight and planar, or curved and planar, or straight and curved either downwardly or upwardly, whereby the track is provided a smooth face. However, the invention is not limited to such a type and other types of toy tracks may be made embodying the invention, such as with rails and rail ties.

We claim:

1. A track system for toy vehicles with straight and curved track pieces which are designed for detachably mounting to a base plate provided with coupling members in a uniform square grid having a building module, m, said track pieces having at the ends thereof, fixed reference points corresponding to a pair of symmetry points of a predetermined square track grid which is uniformly oriented with respect to the grid of the base plate and which is provided with a track module, M, which is a multiple of the building module, m; wherein each curved track piece comprises a longer arcuate segment and an adjacent shorter straight segment, the center of the arcuate segment being displaced from the center of an arc defining an angular range of the curved track piece and having said center in a symmetry point of the track grid, said arc being defined by a pair of radii extending through said pair of symmetry points of the track grid to which said fixed reference points of the curved track piece correspond, and said deplaced center of the arcuate segment being defined by the intersection of the angle bisector of the tangents (T) of said arc at said reference points of the curved track piece and one of the two radii of said arc; and, wherein the length of each straight track piece is in a fixed relationship with the track module, M.

2. The track system in accordance with claim 1, wherein the symmetry points of the track grid are corner points, center points or side bisecting points of squares of the track grid.

3. The track system in accordance with claim 1, wherein the curved track pieces are oriented into groups of left and right curved track pieces.

4. The track system in accordance with claim 1 wherein the angular range of each curved track piece is 45°.

5. The track system in accordance with claim 4, wherein two curved track pieces are fixedly united at the arcuate segments thereof to form a single track piece with an angular range of 90°.

6. The track system in accordance with claim 4, wherein the center of the art is disposed in a corner point of a first square of the track grid and the reference points at the ends of the curved track piece are disposed in the center of a second square or in the side bisecting point of a third square of the track grid, whereby the length of the radii defining the arc are three and a half (3½) times the track module, M.

7. The track system in accordance with claim 6, wherein the shorter straight segment of each curved track piece is disposed parallel to the track grid and the radius (y) of the arcuate segment of the track piece is $$\left(\frac{\sqrt{2}}{\sqrt{2}-1}\right) M.$$

while the displacements (z, z') along the sides of the said squares of the center of the arcuate segment (8) with respect to center of said arc are $$\left(3.5 - \frac{\sqrt{2}}{\sqrt{2} - 1}\right) M$$

in both directions of the track grid in the direction of the arcuate segment.

8. The track system in accordance with claim 7, wherein the two ends of each track piece are provided with indexing means shaped in such a manner that a track piece with reference points at its ends conforms with particular symmetry points of the track grid and is only connectable with a further track piece which maintains such a conformity.

9. The track system in accordance with claim 1, wherein the straight track pieces which are designed to be positioned parallel to the track grid have a length which is a multiple of one half the track module, M, and the straight track pieces designed to be disposed diagonally to the track grid have a length which is in a multiple of $\sqrt{2}$ multiplied by one half the track module, M.

10. The track system in accordance with claim 9, wherein the two ends of each track piece are provided with indexing means shaped in such a manner that a track piece with reference points at its ends conforms with particular symmetry points of the track grid and is only connectable with a further track piece which maintains such a conformity.

11. The track system in accordance with claim 1, wherein the two ends of each track piece are provided with indexing means shaped in such a manner that a track piece with reference points at its ends conforms with particular symmetry points of the track grid and is only connectable with a further track piece which maintains such a conformity.

12. The track system in accordance with claim 11, wherein the end of each curved track piece and the two ends of each straight track piece which are designed to be disposed at an angle of 45° with respect to the track grid have a different code than the corresponding ends of the track pieces which are designed to be disposed parallel to the track grid.

13. The track piece in accordance with claim 12, characterized in that two indexing elements are provided on each end of each track piece.

14. The track system in accordance with claim 11, further comprising incline track pieces that are designed to be disposed at an incline with respect to said base plate, said incline tracks having at the ends thereof indexing means different from the track piece indexing means.

15. The track system in accordance with claim 11, wherein the indexing means comprises elements in form of protrusions and recesses at the ends of each track piece, whereby the protrusions and recesses are shaped for interlocking engagement with corresponding elements of an adjacent track piece.

* * * * *